United States Patent [19]

Van Hoff et al.

[11] Patent Number: 4,508,791

[45] Date of Patent: Apr. 2, 1985

[54] ELECTRIC WIRE WITH A COPPER, SILVER, OR GOLD CORE CLAD WITH TUNGSTEN, MOLYBDENUM OR TUNGSTEN/MOLYBDENUM ALLOY

[75] Inventors: Isidoor K. Van Hoff; Johannes H. P. M. Van Den Bergh, both of Eindhoven, Netherlands

[73] Assignee: U.S. Philips Corporation, New York, N.Y.

[21] Appl. No.: 559,067

[22] Filed: Dec. 7, 1983

Related U.S. Application Data

[62] Division of Ser. No. 346,306, Feb. 5, 1982, Pat. No. 4,455,481.

[30] Foreign Application Priority Data

Feb. 9, 1981 [NL] Netherlands ..... 8100601

[51] Int. Cl.[3] ..... H05B 3/06

[52] U.S. Cl. ..... 428/663; 428/665; 428/212; 428/565; 428/621

[58] Field of Search ..... 428/663, 665, 621, 634

[56] References Cited

U.S. PATENT DOCUMENTS

| | | | |
|---|---|---|---|
| 3,440,408 | 4/1969 | Brittan | 219/522 |
| 3,455,663 | 7/1969 | Zdanuk | 428/665 |
| 3,560,170 | 2/1971 | Dunowächter et al. | 428/565 |
| 3,570,110 | 3/1971 | Zdanuk | 428/665 |
| 3,741,735 | 6/1973 | Buttle | 428/663 |
| 3,852,564 | 12/1974 | Baum et al. | 219/522 |
| 4,190,493 | 2/1980 | Yee | 428/665 |
| 4,286,026 | 8/1981 | Cook et al. | 428/665 |
| 4,321,296 | 3/1982 | Rougier | 428/212 |

*Primary Examiner*—Veronica O'Keefe

*Attorney, Agent, or Firm*—Norman N. Spain

[57] ABSTRACT

Window panes are provided with electrically conductive wires. At the desired small diameter of less than 50 micrometers the wires which have been used so far have too high a resistance per unit length.

The invention provides a sufficiently strong, thin electrically conducting wire having an electric resistivity from 2.0–5.0 $\mu\Omega$cm.

2 Claims, 3 Drawing Figures

Figure 1:
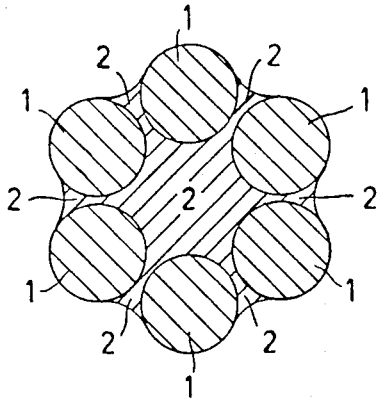

ELECTRIC WIRE WITH A COPPER, SILVER, OR GOLD CORE CLAD WITH TUNGSTEN, MOLYBDENUM OR TUNGSTEN/MOLYBDENUM ALLOY

This is a division of application Ser. No. 346,306, filed Feb. 5, 1982 now U.S. Pat. No. b 4,455,481.

The invention relates to a window pane comprising an electrically conductive wire. The invention also relates to a wire suitable for said window pane.

A window pane according to the invention is, for example, suitable for use as an electrically heatable window pane in motor cars.

European Patent Application No. 7857 discloses a window pane comprising an electrically conductive wire. This prior art window pane may be used in a car window or as alarm glass. The wire used is made of tungsten, ferro-nickel or copper and has a diameter of 15–30 micrometers. More particularly, in accordance with this prior art, a tungsten wire is used having a diameter of 15 micrometers and an electric resistance of 400 ohms per meter (corresponding to a resistivity of 7 $\mu\Omega$/cm).

In order not to impair vision through the window, the wires used are preferably as thin as possible and the wires are arranged in an approximately sinusoidial pattern. Thinner wires however result in a greater resistance of the wire per unit of length. Said sinusoidal pattern results in a comparatively great length of the wire. Both measures result in a high total resistance of the wire. At a given voltage this may result in too low a heat generation.

The invention has for its object to provide a wire which, at a small diameter has a comparatively low resistance per meter, that is to say a low resistivity.

The window pane in accordance with the invention is characterized in that the wire has a diameter of less than 50 micrometers and a resistivity from 2.0 to 5.0 $\mu\Omega$/cm.

So far wires of this type having sufficient strength have not been commercially available. The Applicants have developed a wire which satisfies the above-mentioned requirements. According to the invention, the wire is characterized in that it is in the form of a copper, silver or gold core and a tungsten, molybdenum or a tungsten-molybdenum alloy cladding, and has a diameter of less than 50 micrometers and an electric resistivity from 2.0 to 5.0 $\mu\Omega$/cm.

In accordance with the European Patent application No. 7857 mentioned in the foregoing, the wire may be coated with a paste to reduce the metallic lustre. In the window pane in accordance with the invention a wire may be empolyed which is blackened with graphite or molybdenum disulphide, which effects can be obtained without additional steps when during the drawing procedure graphite or molybdenum disulphide are used as lubricants.

Wires suitable for use in the window pane in accordance with the invention can be produced by means of a method described in U.S. Pat. No. 3,131,469. In this method, in order to obtain the wire in accordance with the invention, a core wire of copper, silver or gold is the starting material around which several, for example six wires of tungsten, molybdenum or of a tungsten-molybdenum alloy are wound. The composite wire thus obtained is then drawn in several steps, intermediate annealing optionally being performed, to the desired diameter. Generally it is preferred to heat the composite wire, prior to drawing, to above the melting point of the core wire in order to obtain a proper mutual bond of the core wire and the wires wound around it.

At a particular diameter the resistance of the wire is in essence determined by the ratio of the quantity of core material to the quantity of cladding material. This ratio may be varied as follows: (1) by the choice of the diameter of the core wire with respect to the diameter of the wires to be wound around the core wire, (2) by the number of wires to be wound around the core (3) by etching away a portion of the cladding.

The electrical resistance of the wire in accordance with the invention is considerably influenced by the diameter of the core. In order to obtain a low electric resistivity from 2.0 to 5.0 $\mu m\Omega$/cm, a pure metal must generally be used for the core wire. The use of alloys or slightly impure metals may be permissible when the resistance does not become too high. The mechanical strength of the wire is predominantly determined by the thickness of the cladding and the nature of the material of the cladding.

The use of molybdenum, tungsten or molybdenum-tungsten alloys has the additional advantage that said materials have a coefficient of expansion which is sufficiently low to embed them in a glass window pane. The window pane may, or course, alternatively be made of plastics or a combination of glass and plastics.

All mentioned resistivity values are those measured at room temperature.

The invention will now be explained in greater detail with reference to a drawing and an example.

Figure 2:
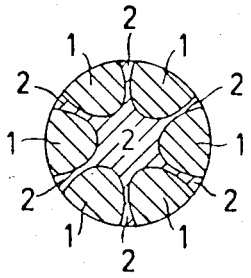
Figure 3:
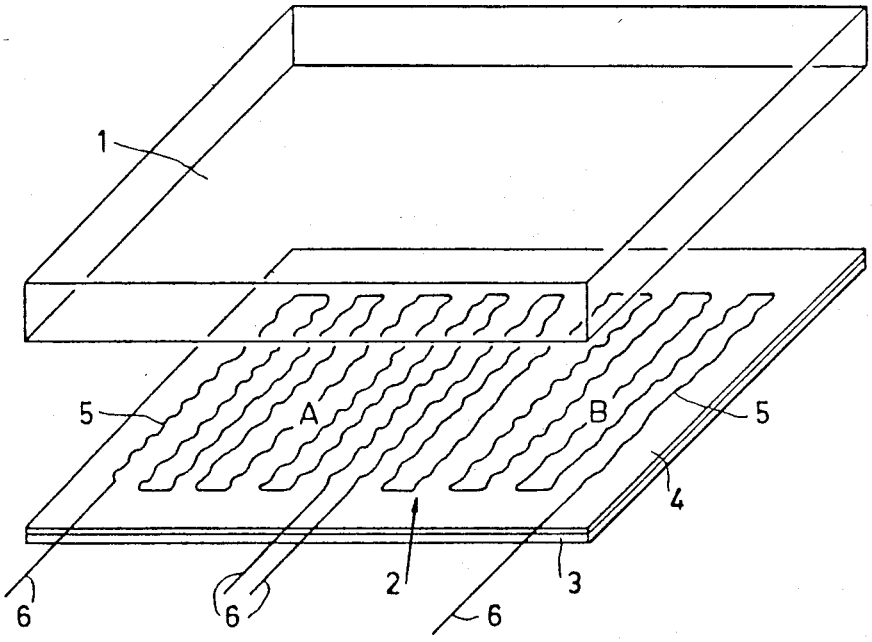

In the drawing:

FIG. 1 represents the cross-section of a composite wire wound from a core and six wires, fused to one integrally wire by heating, FIG. 2 represents a cross-section of the composite wire according to the invention obtained by drawing the composite wire according to FIG. 1 and FIG. 3 represents an example of a window pane according to the invention in which a wire in accordance with FIG. 2 has been incorporated.

In FIGS. 1 and 2 are shown a core wire (2) which may be made of copper, silver or gold and wires (1) which may be made of tungsten, molybdenum or a tungsten-molybdenum alloy. The wire has been manufactured as explained in the following example. FIG. 1 shows a cross-section of the composite wire after fusing to one integrally formed wire before drawing, FIG. 2 shows the same after completion of the drawing operation.

In FIG. 3 is shown an example of a suitable window pane according to the invention. The construction of this window pane is known from the above cited European patent application No. 7857 and is not claimed as such. The window pane comprises a glass support (1), a plastic composite 2 consisting of layers 3 and 4. Layer 4 has adhesive properties. In layer 4 are embedded two sets of wires A and B, made of a wire 5 according to the invention. The ends 6 of the wires are connected to a voltage source (not shown). It goes without saying that other constructions of window panes comprising the inventive wire fall within the claimed scope of invention.

EXAMPLE

A composite wire was wound from a pure copper core wire having a diameter of 415 micrometers and six molybdenum wires, each having a diameter of 400 micrometers. This composite wire was fused to one integrally formed wire by heating. Heating was performed by direct current passage to above the melting point of the copper wire. Thereafter, in approximately 40 steps, the wire was drawn hot to a diameter of 40 μm (the temperature in the conveyer oven used was 850° C.).

The drawing dies and the wire were lubricated with graphite or molybdenum disulphide. Finally, the wire was cold-drawn in some steps to 22 micrometers. The electric resistivity of the wire thus obtained was 3.8 μΩ/cm. The tensile strength was approximately 22.4 GPa (or 240 kgf/mm$^2$).

Thanks to its advantageous resistance value, its small diameter and its good mechanical strength, this wire is perfectly suitably for use in glass or plastic window panes. Window panes of this type may be used in car windows, airplane windows etc., which must be kept free from ice, or as alarm glass. The wires have a matt black appearance due to the use of graphite or molybdenum disulphide as the lubricant during the drawing procedure.

What is claimed is:

1. A wire made of a copper, silver or gold core and a tungsten, molybdenum or tungsten-molybdenum alloy cladding, having a diameter less than 50 micrometers and an electric resistivity from 2.0–5.0 μΩ/cm.

2. The wire of claim 1 blackened with a coating of graphite or molybdenum disulfide.

* * * * *